US011492854B2

(12) United States Patent
Langford et al.

(10) Patent No.: US 11,492,854 B2
(45) Date of Patent: Nov. 8, 2022

(54) ORIENTING SUB

(71) Applicant: Hunting Titan, Inc., Pampa, TX (US)

(72) Inventors: Dale Langford, Pampa, TX (US); Richard Wayne Bradley, Pinehurst, TX (US)

(73) Assignee: Hunting Titan, Inc., Pampa, TX (US)

( * ) Notice: Subject to any disclaimer, the term of this patent is extended or adjusted under 35 U.S.C. 154(b) by 893 days.

(21) Appl. No.: 16/335,870

(22) PCT Filed: Sep. 22, 2017

(86) PCT No.: PCT/US2017/053046

§ 371 (c)(1),
(2) Date: Mar. 22, 2019

(87) PCT Pub. No.: WO2018/057949

PCT Pub. Date: Mar. 29, 2018

(65) Prior Publication Data

US 2019/0257158 A1 Aug. 22, 2019

Related U.S. Application Data

(60) Provisional application No. 62/398,991, filed on Sep. 23, 2016.

(51) Int. Cl.

| | |
|---|---|
| ***E21B 17/046*** | (2006.01) |
| ***E21B 17/043*** | (2006.01) |
| ***E21B 43/117*** | (2006.01) |
| ***E21B 43/11*** | (2006.01) |

(52) U.S. Cl.
CPC ..... *E21B 17/046* (2013.01); *E21B 17/043* (2013.01); *E21B 43/11* (2013.01); *E21B 43/117* (2013.01)

(58) Field of Classification Search
CPC .... E21B 17/046; E21B 43/116; E21B 17/043; E21B 43/119
See application file for complete search history.

(56) References Cited

U.S. PATENT DOCUMENTS

| | | | | |
|---|---|---|---|---|
| 4,566,544 | A * | 1/1986 | Bagley | E21B 43/116 166/318 |
| 5,778,979 | A | 7/1998 | Burleson et al. | |
| 11,091,987 | B1 * | 8/2021 | Benker | E21B 43/119 |
| 2013/0008639 | A1 * | 1/2013 | Tassaroli | E21B 43/116 166/55.2 |
| 2013/0146305 | A1 * | 6/2013 | Dupal | E21B 17/046 166/380 |
| 2014/0050522 | A1 * | 2/2014 | Slaughter, Jr. | E21B 17/046 403/342 |

(Continued)

OTHER PUBLICATIONS

Notification of Transmittal of the International Search Report and the Written Opinion of the International Searching Authority, PCT Application No. PCT/US17/53046, dated Dec. 14, 2017, 8 pages.

*Primary Examiner* — David Bochna

(57) ABSTRACT

An orienting system for precisely aligning downhole tools with respect to each other, such as perforating guns, exploration tools, or other completions tools. The orienting system provides for orienting a first tool with respect to a second tool in a predetermined number of degrees of rotation, and then locking down the combination for use downhole in that configuration.

24 Claims, 5 Drawing Sheets

(56) References Cited

U.S. PATENT DOCUMENTS

| | | | | |
|---|---|---|---|---|
| 2014/0202710 | A1 | 7/2014 | Hales et al. | |
| 2015/0252627 | A1* | 9/2015 | Prill | E21B 17/06 166/242.6 |
| 2016/0333675 | A1* | 11/2016 | Wells | E21B 43/119 |
| 2021/0277753 | A1* | 9/2021 | Ursi | E21B 43/119 |
| 2021/0301599 | A1* | 9/2021 | Mulhern | E21B 43/119 |
| 2021/0355797 | A1* | 11/2021 | Roberts | E21B 43/119 |

* cited by examiner

ORIENTING SUB

RELATED APPLICATIONS

This application claims priority to U.S. Provisional Application No. 62/398,991, filed Sep. 23, 2016.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Currently, perforating guns are often assembled and loaded at a service company shop, transported to the well site, and then armed before they are deployed into a well. Sometimes perforating guns are assembled and armed at the well site. Because the service company shop often employs a single gun loader, maintaining close control on the gun assembly/loading procedures can become difficult. Accordingly, quality control on the assembled/loaded guns may be improved by reducing the amount of assembly necessary at the service company shop.

Many perforating guns are electrically activated. This requires electrical wiring to at least the firing head for the perforating gun. In many cases, perforating guns are run into the well in strings where guns are activated either singly or in groups, often separate from the activation of other tools in the string, such as setting tools. In these cases, electrical communication must be able to pass through one perforating gun to other tools in the string. Typically, this involves threading at least one wire through the interior of the perforating gun and using the gun body as a ground wire.

When typical a perforating gun is assembled/loaded either at the well site or at a service company shop, there is risk of incorrect assembly or damage to electrical wiring or other components that may cause the perforating gun or other tools to fail to fire or fail to function appropriately. For example, the threading of a pass-through wire through the gun body or charge holder presents numerous opportunities for the insulation of the wire to be stripped on sharp metal edges resulting in shorts in the communications circuit. Accordingly, there is a need for a system that eliminates the need to run a wire through a perforating gun body.

Typically, perforating guns and other tools are connected to each other electrically at the well site. This requires that a worker bring the guns or tools close together and then manually make a connection with one or more wires. This requires time and manpower at the well site and introduces the possibility of injury or assembly error. Accordingly, there is a need for a system that eliminates the requirement for workers to make wire connections between perforating guns or tools at the well site.

As discussed above, perforating guns and other tools are often connected with subs that also house related electronic and/or ballistic components. In order to eliminate these subs, a system is needed to house these electrical and ballistic components inside of perforating guns or other tools in an interchangeable and modular way. Additionally, current perforating guns typically have the same diameter and female threads on both ends. In order to eliminate the subs, a perforating gun system that provides male threads on one end of the gun and female threads on the other is needed.

When one or more downhole tools are combined, such as perforating guns, the precise orientation of one tool with respect to another may be desired. Current orienting tools such as electronic orienting tools, for example magnetic orienting tool (MOT), add length to the tool string that results in expense and are limited in capacity to shoot multiple long gun strings. A need exist for a compact orienting tool that can join two or more downhole tools in precise angular orientation with respect to each other.

SUMMARY OF EXAMPLE EMBODIMENTS

An example embodiment may include an apparatus for joining two downhole cylindrical bodies having a first cylindrical portion with a first diameter about a common axis having a first end with a face, a second cylindrical portion adjacent to, coaxial with, and integral with the first cylindrical portion about the common axis, having a second diameter larger than the first diameter, and a second end with a face, a shoulder located on the second cylindrical portion, having a third diameter larger than the second diameter, located proximate to the first cylindrical portion, wherein a third face is formed adjacent to the first portion, a plurality of holes located radially about the first cylindrical portion, with a predetermined angular distance between each hole, and being located proximate to the flange on the second cylindrical portion, and a thru bore extending from the face of the first cylindrical portion to the face of the second cylindrical portion.

A variation of the example embodiment may include one or more o-ring grooves on the first cylindrical portion. It may have one or more o-ring grooves on the second cylindrical portion. The plurality of holes may be adapted to accept a plurality of roll pins. The thru bore may provide a location for electrical wiring. The third face may be a flat face. The first cylindrical body being joined may be a perforating gun. The second cylindrical body being joined may be a perforating gun.

An example embodiment may include a system for joining two downhole cylindrical bodies having an orienting mandrel with a first cylindrical portion with a first diameter about a common axis having a first end with a face, a second cylindrical portion adjacent to, coaxial with, and integral with the first cylindrical portion about the common axis, having a second diameter larger than the first diameter, and a second end with a face, a shoulder located on the second cylindrical portion, having a third diameter larger than the second diameter, located proximate to the first cylindrical portion, wherein a third face is formed adjacent to the first portion, a plurality of holes located radially about the first cylindrical portion, with a predetermined angular distance between each hole, and being located proximate to the flange on the second cylindrical portion, and a thru bore extending from the face of the first cylindrical portion to the face of the second cylindrical portion. It may also include a top sub with a first bore, slideably engaged with the first cylindrical portion of the orienting mandrel, and coupled to the cylindrical collar, the top sub having a first face with a plurality of slots. It may also include a bottom sub with a first bore adapted to slideably engage with the second cylindrical portion of the orienting mandrel. It may also include a cylindrical collar slideably engaged with the bottom collar, coupled to the top sub, with an internal shoulder engaged to the mandrel shoulder. It may also include a plurality of roll pins inserted into the plurality of radial holes on the orienting mandrel and engaged with the plurality of slots.

The example embodiment may have one or more o-ring grooves on the first cylindrical portion. It may have one or more o-ring grooves on the second cylindrical portion. The plurality of holes may be adapted to accept a plurality of roll pins. It may include a set screw coupled tangentially through the cylindrical collar and engaged with a circumferential groove in the top sub. It may include a set screw coupled tangentially through the cylindrical collar and engaged with the top sub. It may include a wire port plug located tangentially in the top sub. The first cylindrical body being joined may be a perforating gun. The second cylindrical body being joined may be a perforating gun. The cylindrical collar may capture the orienting mandrel against the shoulder with the cylindrical collar connected to the top sub.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
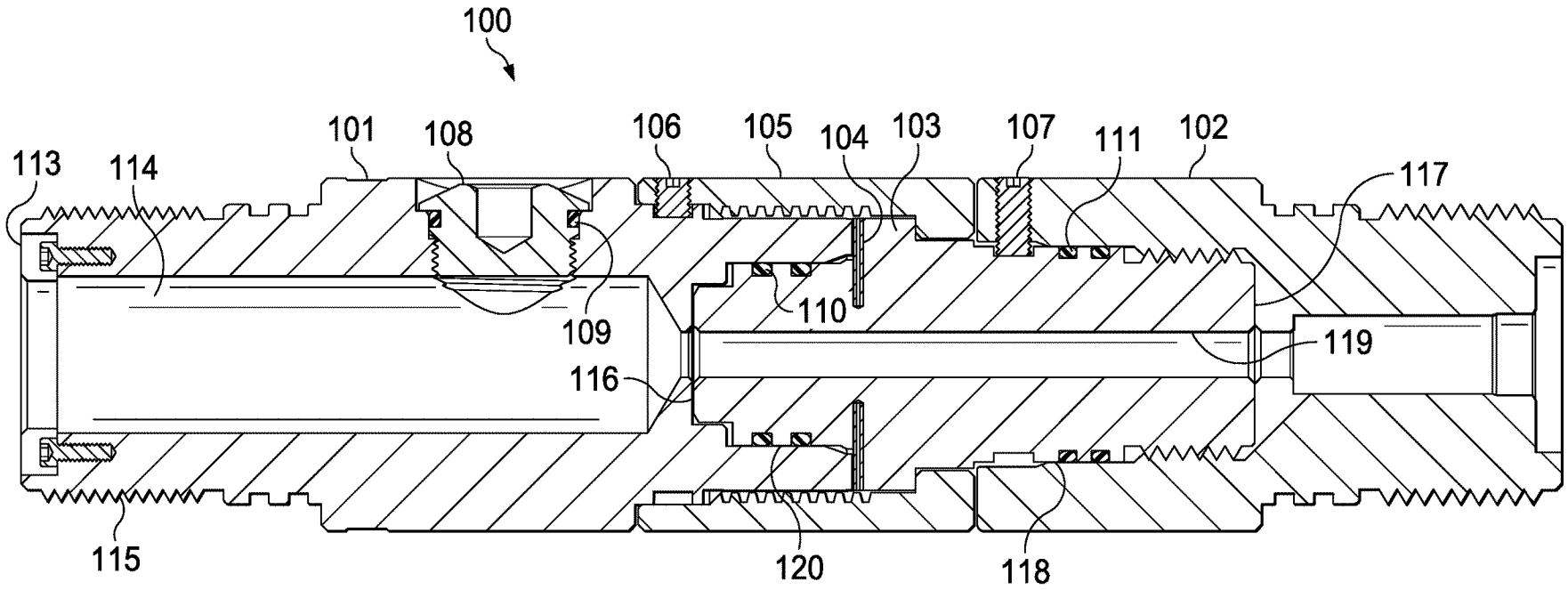
FIG. 1 depicts a cross section of the mandrel coupled to two downhole tools.

An example embodiment is shown in FIG. 1 of an orienting sub assembly 100. The top sub 101 has a first end 113. First end 113 has a hollow inner bore 114. First end 113 has threads 115 for mating to another sub or to an assembly. Socket head cap screws 112 are located at the first end. A wire port plug 108 is threaded tangentially into the body of the top sub 101. Wire port plug 108 is sealed using o-ring 109.

The bottom sub 102 is coupled to the top sub 101 using an orienting mandrel 103 in combination with a retaining collar 105. The retaining collar 115 has a first end 116 and a second end 117. The second end 117 is slideably engaged with and then threaded into the inner bore 118 of the bottom sub 102. The orienting mandrel 103 has a thru bore 119 going from the first end 116 to the second end 117. The first end 116 is slideably engaged with a second bore 120 of the top sub 101. O-rings 110 seal the second bore 120 against the first end 116. Roll pins 104 lock the orienting mandrel 103 in an axial position, measured in degrees, relative to the top sub 101. The set screw 106 locks the retaining collar 115 into the top sub 101. The set screw 107 locks the bottom sub 102 into the orienting mandrel 103. The retaining collar 115 captures the orienting mandrel 103 by engaging the shoulder of the orienting mandrel 103 when it is coupled to, in this example via threads, the top sub 101. Once the retaining collar 115 is threaded to the top sub 101 and captures the orienting mandrel 103, the set screw 106 is threaded tangentially through the retaining collar 115 and into a circumferential groove located about the top sub 101.

Figure 2:
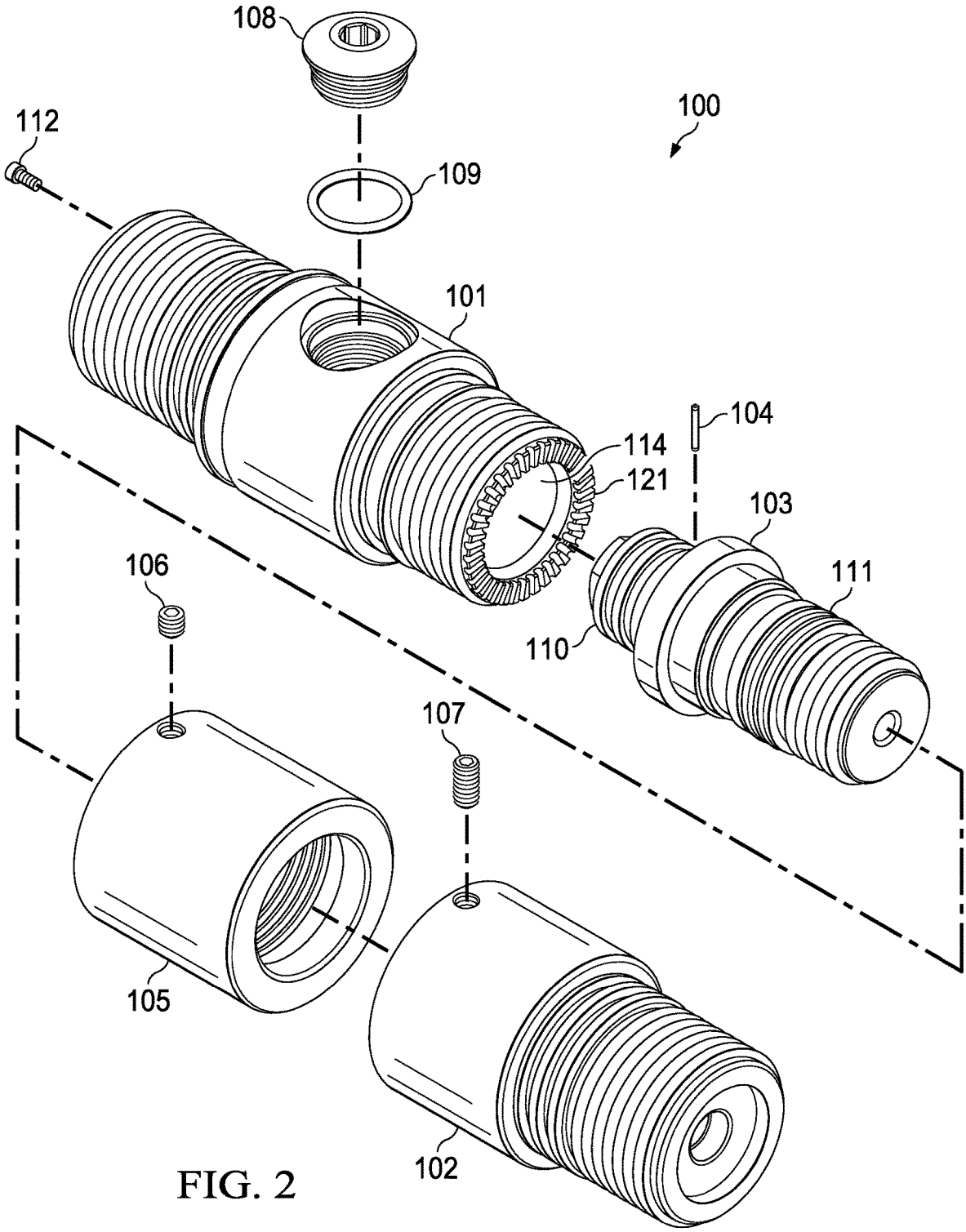
FIG. 2 depicts an exploded view of the mandrel used for orienting and coupling downhole tools.

An example embodiment is shown in FIG. 2 of an exploded assembly view of the orienting sub assembly 100. The bottom sub 102 is coupled to the top sub 101 using an orienting mandrel 103 in combination with a retaining collar 105. The retaining collar 115 has a first end 116 and a second end 117. The second end 117 is slideably engaged with and then threaded into the inner bore 118 of the bottom sub 102. The orienting mandrel 103 has a thru bore 119 going from the first end 116 to the second end 117. The first end 116 is slideably engaged with a second bore 120 of the top sub 101. O-rings 110 seal the second bore 120 against the first end 116. Roll pins 104 lock the orienting mandrel 103 in an axial position, measured in degrees, relative to the top sub 101. The set screw 106 locks the retaining collar 115 into the top sub 101. The set screw 107 locks the bottom sub 102 into the orienting mandrel 103. In this view slots 121 are visible surrounding inner bore 114.

In the example embodiment shown in FIG. 2 there are 36 slots which allows for ten degree incremental alignments between the top sub 101 and the bottom sub 102. The additional detail shows slots 121 on the face of the top sub 101. In this example there are 36 slots, allowing for ten degree incremental orientation changes between the top sub 101 and the bottom sub 102 via the orienting mandrel 103. Each orienting mandrel 103 has a plurality of holes located axially about the center axis for accepting roll pins 104. In this example there are 6 roll pins 104 located about the axis in sixty degree increments.

Figure 3:
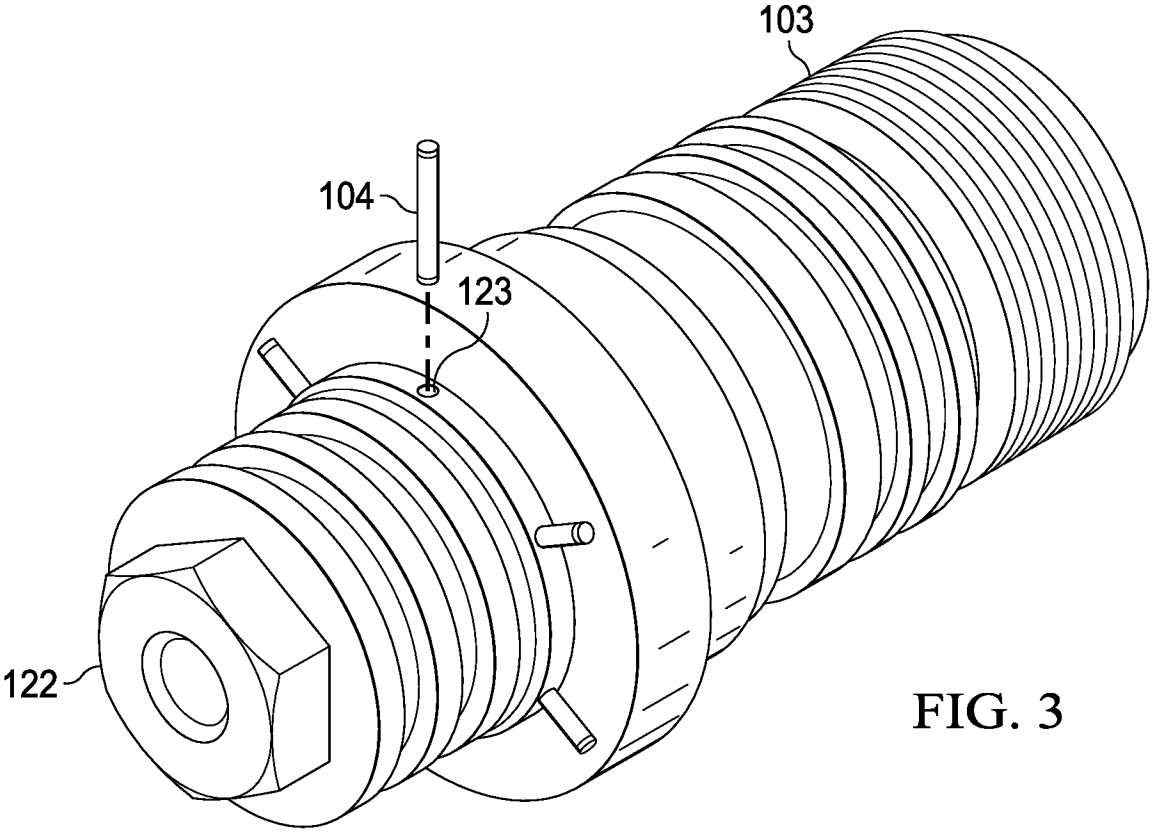
FIG. 3 depicts a perspective view of the orienting mandrel to show the roll pins.

The roll pins 104 and the holes 123 can be seen in FIG. 3 showing the orienting mandrel 103 from a different direction. The roll pins 104 fit into the holes 123. When the orienting mandrel 103 is located and coupled to the top sub 101 the roll pins 104 will interface with the slots 121 to lock the mandrel in a specific axial orientation with respect to the top sub 101. Since the bottom sub 102 is locked into a predetermined orientation with the orienting mandrel 103 via the retaining collar 105 and the set screws 106 and 107, the orientation of the top sub 101 with respect to the bottom sub 102 can be accurately controlled within the ten degree increments of slots 121.

Figure 4:
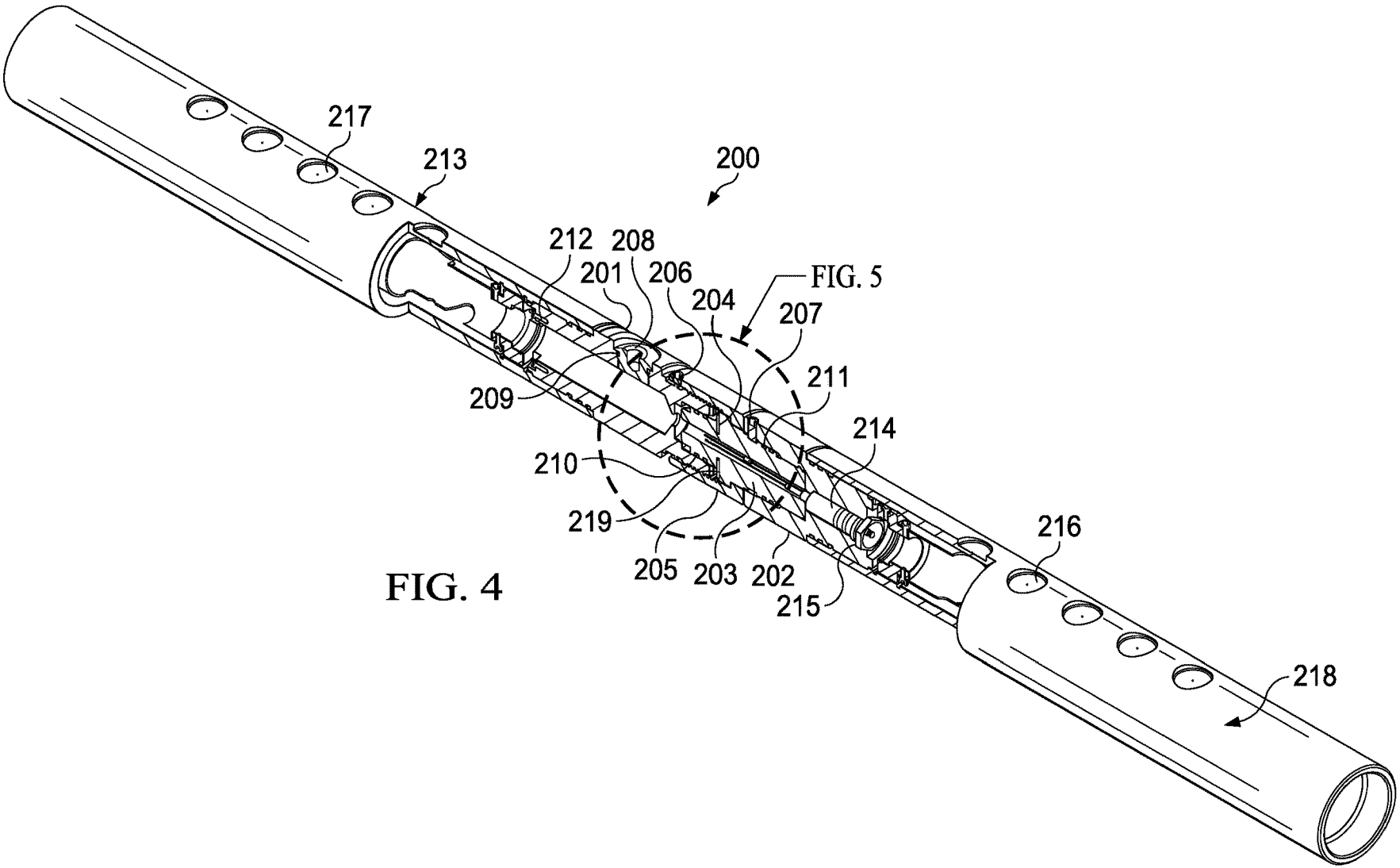
FIG. 4 depicts a perspective view with a cross sectional cutout of two perforating guns joined by the orienting mandrel.

Referring to the example embodiment in FIG. 4, the assembly 200 here includes a first gun assembly 213 coupled to top sub 201. Top sub 201 is has an orienting mandrel 203 coupled downhole in relation to the first gun 213. A bottom sub 202 is coupled downhole from the orienting mandrel 203. A second gun assembly 218 is coupled to and located downhole of the bottom sub 202. The top sub 201 has a wire port plug 208 that is sealed with o-ring 209. Set screw 206 is used to aid in securing the top sub 201 to the retaining collar 205. O-rings 210 and 211 aid in sealing any wiring that passes through orienting mandrel 203 from wellbore fluids. A cartridge connector 214, secured with retainer nut 215, is used to transfer electrical signals passed through the center bore of the orienting mandrel, thus electrically coupling the first perforating gun 213 with the second perforating gun 218. Both perforating guns 213 and 218 have scallops 217 and 216, respectively, at a zero phase angle, meaning they are axially aligned and do not rotate about the center axis. However, the scallops 217 and 216 can be in any phase angle and they do not need to be the same phase angle as shown in this example embodiment.

The roll pins 204 that are coupled to the alignment slots 219 located on the face of the top sub 201. This allows precise control of the angle between the first perforating gun 213 and the second perforating gun 218.

In FIG. 4 two perforating guns 213 and 218 are shown joined by orienting mandrel 203, however a series of orienting mandrels and guns can be used to create a long gun string. There could be an additional orienting mandrel coupled to the open ends of perforating guns 213 and 218. Furthermore, downhole tools other than perforating guns can be joined to perforating guns, or to other downhole tools depending on the need. The orienting mandrel will allow for precise control of the angular orientation between downhole tools coupled together.

Figure 5:
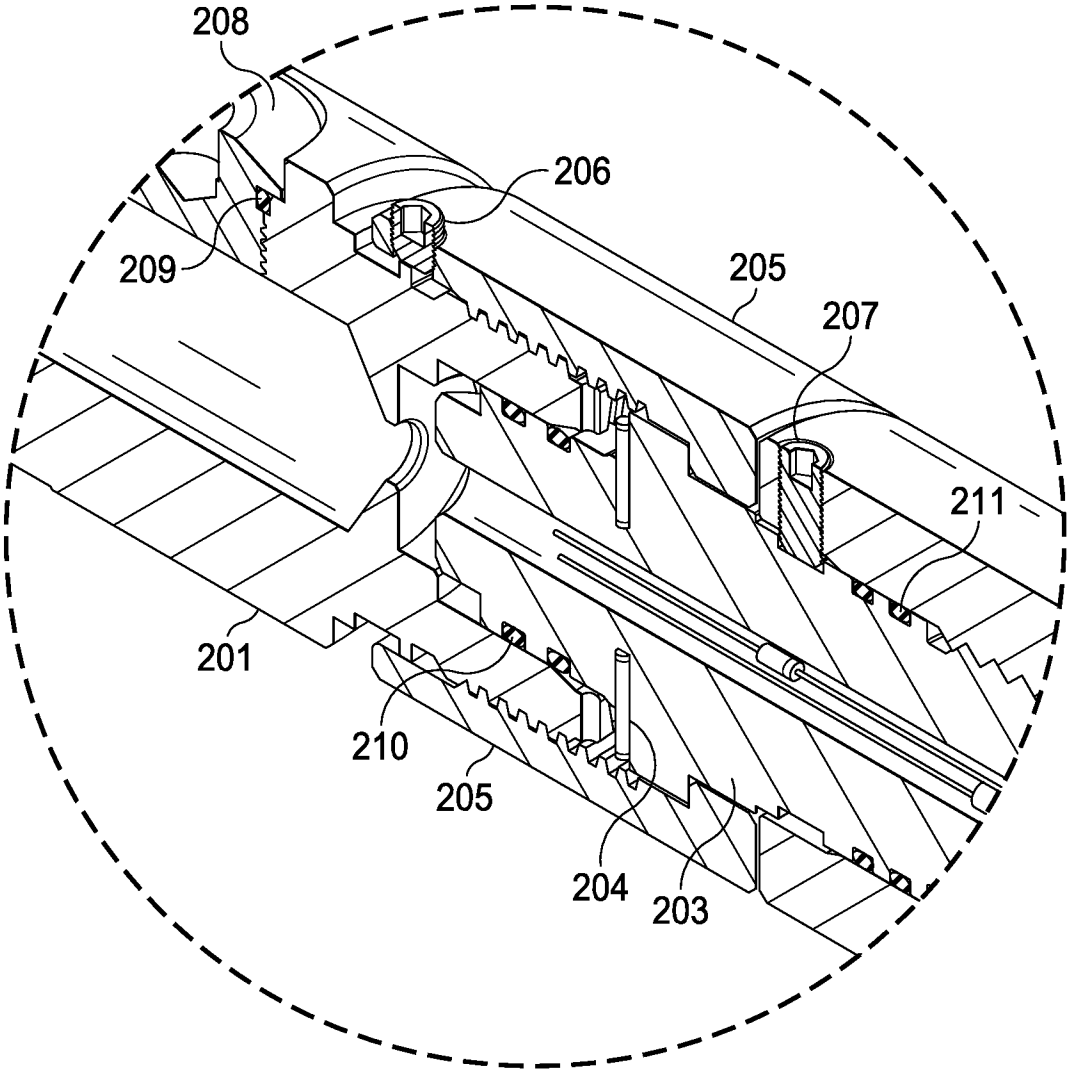
FIG. 5 depicts a close-up of the orienting mandrel engagement as shown in FIG. 4.

A closer view of the orienting coupling is shown in FIG. 5 where the top sub 201 is threaded into the retaining collar 205, which is further coupled to the orienting mandrel 203. The alignment slots 218 machined into the bottom face of the top sub 201 is held in place relative to the orienting mandrel 203 by roll pins 204.

Another example embodiment of the orienting mandrel is to align a downhole tool on one end with a perforating gun on the other end. Another example embodiment may include connecting a series of perforating guns or downhole tools using a plurality of mandrels, while maintaining predetermined orientation angles between each device.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A system for joining two downhole cylindrical bodies comprising:

an orienting mandrel further comprising:

a first cylindrical portion with a first diameter about a common axis having a first end with a face;

a second cylindrical portion adjacent to, coaxial with and integral with the first cylindrical portion about the common axis, having a second diameter larger than the first diameter, and a second end with a face;

a shoulder located on the second cylindrical portion, having a third diameter larger than the second diameter, located proximate to the first cylindrical portion, wherein a third face is formed adjacent to the first portion;

a plurality of holes located radially about the first cylindrical portion, with a predetermined angular distance between each hole, and being located proximate to the flange on the second cylindrical portion; and a thru bore extending from the face of the first cylindrical portion to the face of the second cylindrical portion;

a top sub with a first bore, slideably engaged with the first cylindrical portion of the orienting mandrel, and coupled to the cylindrical collar, the top sub having a first face with a plurality of slots;

a bottom sub with a first bore adapted to slideably engage with the second cylindrical portion of the orienting mandrel;

a cylindrical collar slideably engaged with a bottom collar, coupled to the top sub, with an internal shoulder engaged to the mandrel shoulder;

a wire port plug located radially in the top sub;

a plurality of roll pins inserted into the plurality of radial holes on the orienting mandrel and engaged with the plurality of slots.

2. The apparatus of claim 1 further comprising one or more o-ring grooves on the first cylindrical portion.

3. The apparatus of claim 1 further comprising one or more o-ring grooves on the second cylindrical portion.

4. The apparatus of claim 1 further comprising a set screw coupled radially through the cylindrical collar and engaged with a circumferential groove in the top sub.

5. The apparatus of claim 1 further comprising a set screw coupled radially through the cylindrical collar and engaged with the top sub.

6. The apparatus of claim 1 wherein the first cylindrical body being joined is a perforating gun.

7. The apparatus of claim 1 wherein the second cylindrical body being joined is a perforating gun.

8. The apparatus of claim 1 wherein the cylindrical collar captures the orienting mandrel against the shoulder with the cylindrical collar connected to the top sub.

9. A system for joining two downhole cylindrical bodies comprising:

an orienting mandrel further comprising:

a first cylindrical portion of a perforating gun with a first diameter about a common axis having a first end with a face;

a second cylindrical portion adjacent to, coaxial with and integral with the first cylindrical portion about the common axis, having a second diameter larger than the first diameter, and a second end with a face;

a shoulder located on the second cylindrical portion, having a third diameter larger than the second diameter, located proximate to the first cylindrical portion, wherein a third face is formed adjacent to the first portion;

a plurality of holes located radially about the first cylindrical portion, with a predetermined angular distance between each hole, and being located proximate to the flange on the second cylindrical portion; and a thru bore extending from the face of the first cylindrical portion to the face of the second cylindrical portion;

a top sub with a first bore, slideably engaged with the first cylindrical portion of the orienting mandrel, and coupled to the cylindrical collar, the top sub having a first face with a plurality of slots;

a bottom sub with a first bore adapted to slideably engage with the second cylindrical portion of the orienting mandrel;

a cylindrical collar slideably engaged with a bottom collar, coupled to the top sub, with an internal shoulder engaged to the mandrel shoulder;

a plurality of roll pins inserted into the plurality of radial holes on the orienting mandrel and engaged with the plurality of slots.

10. The apparatus of claim 9 further comprising one or more o-ring grooves on the first cylindrical portion.

11. The apparatus of claim 9 further comprising one or more o-ring grooves on the second cylindrical portion.

12. The apparatus of claim 9 further comprising a set screw coupled radially through the cylindrical collar and engaged with a circumferential groove in the top sub.

13. The apparatus of claim 9 further comprising a set screw coupled radially through the cylindrical collar and engaged with the top sub.

14. The apparatus of claim 9 further comprising a wire port plug located radially in the top sub.

15. The apparatus of claim 9 wherein the second cylindrical body being joined is a perforating gun.

16. The apparatus of claim 9 wherein the cylindrical collar captures the orienting mandrel against the shoulder with the cylindrical collar connected to the top sub.

17. A system for joining two downhole cylindrical bodies comprising:

an orienting mandrel further comprising:

a first cylindrical portion with a first diameter about a common axis having a first end with a face;

a second cylindrical portion adjacent to, coaxial with and integral with the first cylindrical portion about the common axis, having a second diameter larger than the first diameter, and a second end with a face;

one or more o-ring grooves on the second cylindrical portion;

a shoulder located on the second cylindrical portion, having a third diameter larger than the second diameter, located proximate to the first cylindrical portion, wherein a third face is formed adjacent to the first portion;

a plurality of holes located radially about the first cylindrical portion, with a predetermined angular distance between each hole, and being located proximate to the flange on the second cylindrical portion; and a thru bore extending from the face of the first cylindrical portion to the face of the second cylindrical portion;

a top sub with a first bore, slideably engaged with the first cylindrical portion of the orienting mandrel, and coupled to the cylindrical collar, the top sub having a first face with a plurality of slots;

a bottom sub with a first bore adapted to slideably engage with the second cylindrical portion of the orienting mandrel;

a cylindrical collar slideably engaged with a bottom collar, coupled to the top sub, with an internal shoulder engaged to the mandrel shoulder;

a plurality of roll pins inserted into the plurality of radial holes on the orienting mandrel and engaged with the plurality of slots.

18. The apparatus of claim 17 further comprising one or more o-ring grooves on the first cylindrical portion.

19. The apparatus of claim 17 further comprising a set screw coupled radially through the cylindrical collar and engaged with a circumferential groove in the top sub.

20. The apparatus of claim 17 further comprising a set screw coupled radially through the cylindrical collar and engaged with the top sub.

21. The apparatus of claim 17 further comprising a wire port plug located radially in the top sub.

22. The apparatus of claim 17 wherein the first cylindrical body being joined is a perforating gun.

23. The apparatus of claim 17 wherein the second cylindrical body being joined is a perforating gun.

24. The apparatus of claim 17 wherein the cylindrical collar captures the orienting mandrel against the shoulder with the cylindrical collar connected to the top sub.

* * * * *